US009323213B2

(12) United States Patent
Moon et al.

(10) Patent No.: US 9,323,213 B2
(45) Date of Patent: Apr. 26, 2016

(54) CARTRIDGE AND ELECTROPHOTOGRAPHIC IMAGE FORMING APPARATUS USING THE SAME

(71) Applicant: SAMSUNG ELECTRONICS CO., LTD., Suwon-si, Gyeonggi-do (KR)

(72) Inventors: Ji-won Moon, Suwon-si (KR); Joon-hee Kim, Seoul (KR); Ho-jin Jang, Suwon-si (KR); Yun-kyu Sim, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/573,005

(22) Filed: Dec. 17, 2014

(65) Prior Publication Data

US 2015/0261177 A1 Sep. 17, 2015

(30) Foreign Application Priority Data

Mar. 12, 2014 (KR) ..... 10-2014-0029160

(51) Int. Cl.
*G03G 15/00* (2006.01)
*G03G 21/16* (2006.01)

(52) U.S. Cl.
CPC ..... *G03G 21/1676* (2013.01); *G03G 21/1647* (2013.01)

(58) Field of Classification Search
CPC ..... G03G 15/556; G03G 21/1647; G03G 15/0266; G03G 15/0831; G03G 15/043; G03G 15/0863; G03G 15/0865; G03G 15/0889; G03G 15/2039; G03G 15/50; G03G 21/1676; G03G 15/0121; G03G 15/0291
See application file for complete search history.

(56) References Cited

U.S. PATENT DOCUMENTS

| | | | | |
|---|---|---|---|---|
| 6,865,349 | B2 | 3/2005 | Silence et al. | |
| 2003/0091361 | A1 | 5/2003 | Noda et al. | |
| 2003/0170042 | A1 | 9/2003 | Okamoto et al. | |
| 2006/0228127 | A1 | 10/2006 | Miyabe et al. | |
| 2007/0098437 | A1 | 5/2007 | Kaiga | |
| 2008/0226342 | A1 * | 9/2008 | Deguchi | 399/119 |
| 2012/0039622 | A1 | 2/2012 | Cho | |

FOREIGN PATENT DOCUMENTS

| | | |
|---|---|---|
| JP | 2004-46808 | 2/2004 |
| JP | 2011-164398 | 8/2011 |
| KR | 10-2007-0047177 | 5/2007 |

OTHER PUBLICATIONS

International Search Report and Written Opinion of the International Searching Authority dated Feb. 11, 2015 in International Patent Application No. PCT/KR2014/010471.

* cited by examiner

*Primary Examiner* — Roy Y Yi
(74) *Attorney, Agent, or Firm* — Staas & Halsey LLP

(57) ABSTRACT

A cartridge that is attached to or detached from a main body of an image forming apparatus, including: a memory unit that includes a contact portion via which the cartridge is connected to the main body and that is connected to the main body to transmit information of the cartridge to the main body; and a moving member on which the contact portion is mounted, wherein the moving unit is moved to a second position where the contact portion is protruded out of the cartridge in order to be connected to a connection portion provided in the main body and a first position that is hidden inside the cartridge.

36 Claims, 15 Drawing Sheets

CARTRIDGE AND ELECTROPHOTOGRAPHIC IMAGE FORMING APPARATUS USING THE SAME

CROSS-REFERENCE TO RELATED APPLICATIONS

This application claims the benefit of Korean Patent Application No. 10-2014-0029160, filed on Mar. 12, 2014, in the Korean Intellectual Property Office, the disclosure of which is incorporated herein in its entirety by reference.

BACKGROUND

Field of the Invention

One or more embodiments relate to an image forming apparatus capable of forming an image on a recording medium and a cartridge that is attached to or detached from the image forming apparatus.

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

A process cartridge is an assembly of components for forming a visible toner image, and is a consumable product that is detachable from a main body of an image forming apparatus and replaceable after the life thereof is ended. A process cartridge may have various structures such as a structure in which a photoreceptor, a development roller that supplies toner to the photoreceptor, and a container portion containing toner are integrally formed, a structure divided into an image cartridge including a photoreceptor and a development roller and a toner cartridge containing toner, or a structure divided into a photoreceptor cartridge including a photoreceptor, a development cartridge including a development roller, and a toner cartridge containing toner.

A cartridge includes a memory unit in which various types of information about the cartridge are stored. When the cartridge is mounted in a main body, the memory unit is electrically connected to the main body to communicate with the main body and may transmit information about the cartridge to the main body. The memory unit includes a contact portion that is electrically connected to a connection portion of the main body.

SUMMARY

One or more embodiments include a cartridge capable of preventing pollution of a contact portion of a memory unit included in the cartridge and an image forming apparatus using the cartridge.

One or more embodiments include a cartridge capable of preventing damage to a contact portion of a memory unit and an image forming apparatus using the cartridge.

One or more embodiments include a cartridge capable of preventing a connection error between a main body and the cartridge and an image forming apparatus using the cartridge.

Additional aspects will be set forth in part in the description which follows and, in part, will be apparent from the description, or may be learned by practice of the presented embodiments.

According to one or more embodiments, a cartridge that is attached to or detached from a main body of an image forming apparatus, includes: a memory unit that includes a contact portion via which the cartridge is connected to the main body and that is connected to the main body to transmit information of the cartridge to the main body; and a moving member on which the contact portion is mounted, wherein the moving member is moved to a second position where the contact portion is protruded out of the cartridge in order to be connected to a connection portion provided in the main body and a first position that is hidden inside the cartridge.

The moving member may be pivoted with respect to a pivoting shaft to be moved to the first and second positions, wherein the cartridge further includes a first elastic member that applies an elastic force to the moving member so that the moving member returns to the first position.

The contact portion may be mounted at a first end portion of the moving member, wherein when the cartridge is mounted in the main body, a second end portion of the moving member is pushed by an interference member provided in the main body so that the moving member is pivoted with respect to the pivoting shaft so as to be moved to the second position.

The moving member may further include: a mounting portion connected to the pivoting shaft, wherein the contact portion is mounted on the mounting portion; and a lever provided at an end of the pivoting shaft to be exposed to outside of the cartridge, wherein when the cartridge is mounted in the main body, the lever is pushed by the interference member provided in the main body so that the moving member is pivoted with respect to the pivoting shaft so as to be moved to the second position.

The cartridge may further include: a first exit through which the contact portion goes in and out; a shutter that opens or closes the first exit; and a second elastic member that provides an elastic force to the shutter in a direction to close the first exit.

The moving member may include an interference arm to push the shutter to open the first exit when the cartridge is mounted in the main body.

The moving member may be slid to be moved to the first and second positions.

The cartridge may include: a rack gear formed on the moving member; and a pinion that is engaged with the rack gear and is rotated by an interference member provided in the main body when the cartridge is attached to or detached from the main body.

The cartridge may include: a pivoting shaft including a lever that is formed at an end portion of the pivoting shaft and is exposed to outside of the cartridge such that the lever is pivoted by being pushed by an interference member provided in the main body when the cartridge is mounted in the main body; a pinion that is rotated in connection with the pivoting shaft; and a rack gear that is provided on the moving member and is engaged with the pinion.

The cartridge may further include a first elastic member that provides an elastic force so that the pinion is pivoted in a direction in which the moving member returns to the first position.

The cartridge may further include a toner containing unit containing toner.

The cartridge may further include: a development roller; and a toner containing unit containing toner to be supplied to the development roller.

The cartridge may further include: a toner containing unit containing toner; a photoconductor on which an electrostatic latent image is formed; and a development roller that supplies the toner of the toner containing unit to the electrostatic latent image.

According to one or more embodiments, an image forming apparatus includes: a main body; and the cartridge described above, wherein the cartridge is attached to or detached from the main body.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
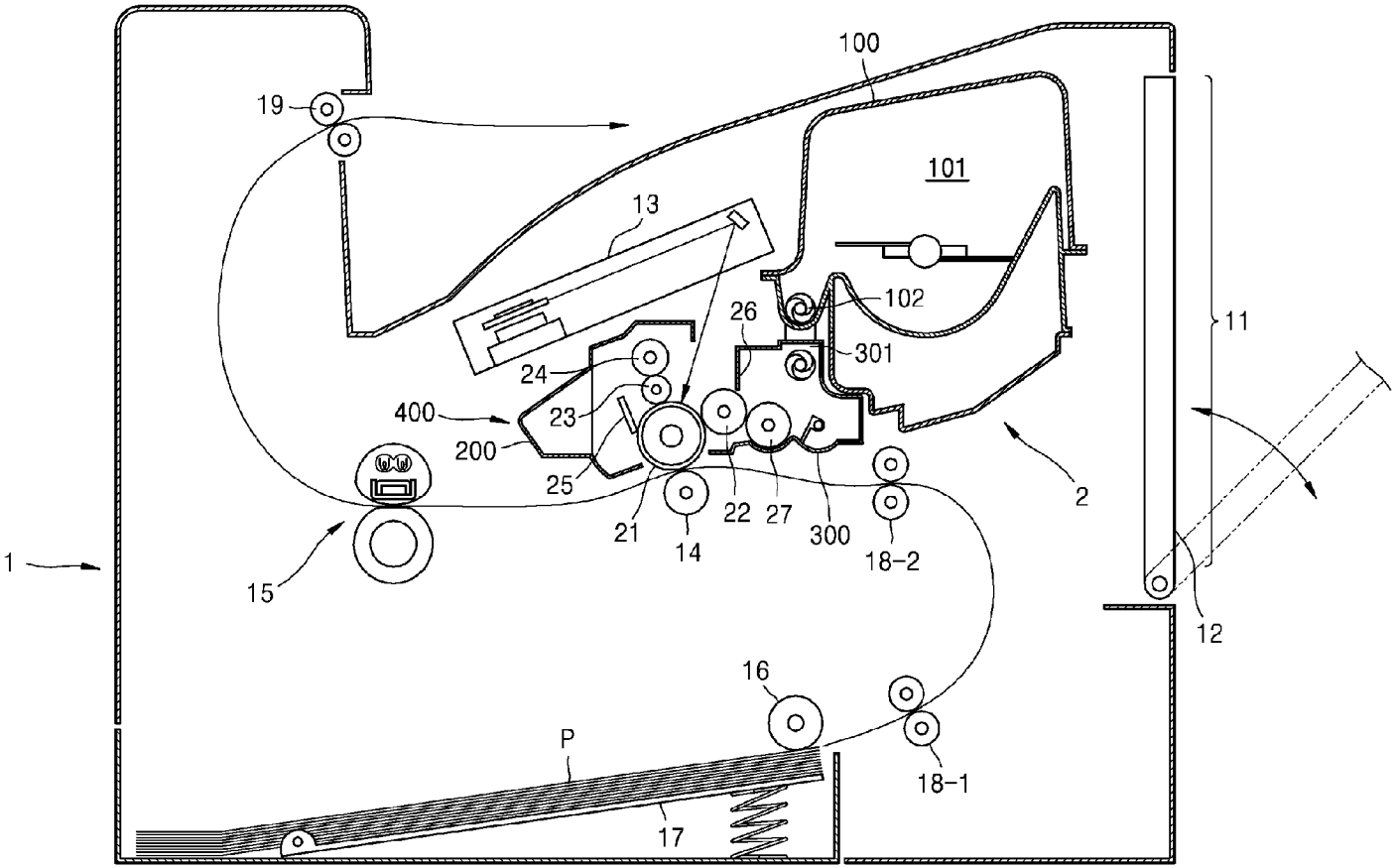
FIG. 1 is a schematic structural diagram of an electrophotographic image forming apparatus according to an embodiment.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic structural diagram of an electrophotographic image forming apparatus according to an embodiment.

Referring to FIG. 1, a main body 1 and a process cartridge 2 are shown. The main body 1 includes an opening 11 providing a passage for the process cartridge 2 to be mounted or removed. A cover 12 closes or opens the opening 11. The main body 1 includes an exposure unit 13, a transfer roller 14, and a fusing unit 15. Also, the main body 1 includes a recording medium transfer structure for loading and transferring a recording medium P where an image is to be formed.

The process cartridge 2 may include a toner containing unit 101, a photoconductive drum 21, on a surface of which an electrostatic latent image is formed, and a development roller 22 that receives toner from the toner containing unit 101 to supply the toner to the electrostatic latent image so as to develop the electrostatic latent image to a visible toner image.

The photoconductive drum 21 is an example of a photoreceptor, wherein an electrostatic latent image is formed on a surface thereof, and may include a conductive metal pipe and a photosensitive layer around the conductive metal pipe. A charging roller 23 is an example of a charger for charging the photoconductive drum 21 to have uniform surface potential. A charging brush or a corona charger may be used instead of the charging roller 23. A reference numeral 24 denotes a cleaning roller for removing foreign materials on a surface of the charging roller 23. A cleaning blade 25 is an example of a cleaning unit for removing toner and foreign materials on a surface of the photoconductive drum 21 after a transfer process which is described later. A cleaning apparatus having another shape, such as a rotating brush, may be used instead of the cleaning blade 25.

Figure 2A:
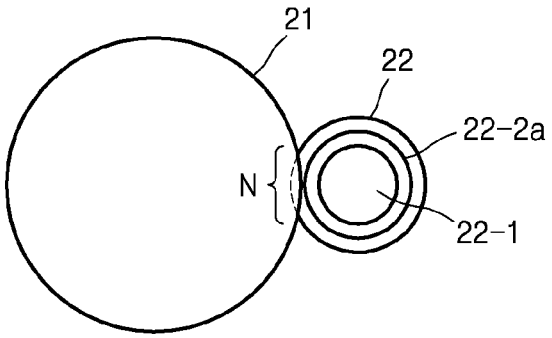
FIG. 2A is a diagram of an arrangement of a photoconductive drum and a development roller in a contact development method.
Figure 2B:
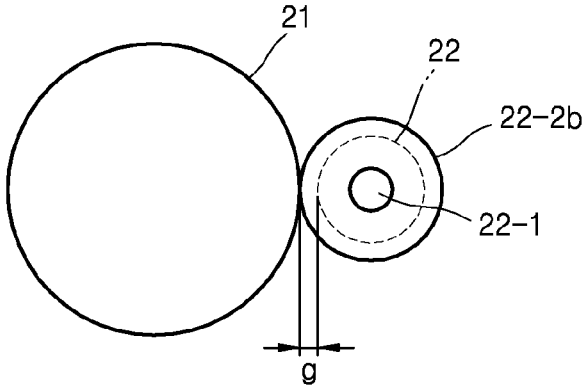
FIG. 2B is a diagram of an arrangement of a photoconductive drum and a development roller in a non-contact development method.

Examples of a development method include a one-component development method in which toner is used and a two-component development method in which toner and a carrier are used. The process cartridge 2 according to the current embodiment uses a one-component development method. The development roller 22 is used to supply toner to the photosensitive drum 21. A development bias voltage may be applied to the development roller 22 to thereby supply toner to the photosensitive drum 21. The one-component development method may be classified into a contact development method, wherein the development roller 22 and the photoconductive drum 21 are rotated while contacting each other, and a non-contact development method, wherein the development roller 22 and the photoconductive drum 21 are rotated while being spaced apart from each other by dozens to hundreds of microns. FIG. 2A is a diagram of an arrangement of the photoconductive drum 21 and the development roller 22 in the contact development method, and FIG. 2B is a diagram of an arrangement of the photoconductive drum 21 and the development roller 22 in the non-contact development method. Referring to FIG. 2A, in the contact development method, a gap maintaining member 22-2*a* having a smaller diameter than the development roller 22 may be provided on each of both ends of a rotation shaft 22-1 of the development roller 22. An amount of contact between the development roller 22 and the photoconductive drum 21 is constrained by the gap maintaining member 22-2*a* which contacts the surface of the photoconductive drum 21. A development nip N is formed as the development roller 22 contacts the photoconductive drum 21. Referring to FIG. 2B, in the non-contact development method, a gap maintaining member 22-2*b* having a larger diameter than the development roller 22 may be provided on each of both ends of the rotation shaft 22-1 of the development roller 22. A development gap g between the development roller 22 and the photoconductive drum 21 is constrained by the gap maintaining member 22-2*b* which contacts the surface of the photoconductive drum 21.

A regulator 26 constrains an amount of toner supplied from the development roller 22 to a development region where the photoconductive drum 21 and the development roller 22 face each other. The regulator 26 may be a doctor blade elastically contacting a surface of the development roller 22. A supply roller 27 supplies toner in the process cartridge 2 to a surface of the development roller 22. To this end, a supply bias voltage may be applied to the supply roller 27.

When a two-component development method is used, the development roller 22 is spaced apart from the photoconductive drum 21 by dozens to hundreds of microns. Although not illustrated in the drawings, the development roller 22 may have a structure in which a magnetic roller is disposed in a hollow cylindrical sleeve. The toner is adhered to a surface of a magnetic carrier. The magnetic carrier is adhered to the surface of the development roller 22 to be transferred to the development region where the photoconductive drum 21 and the development roller 22 face each other. Only the toner is supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not shown) for mixing and stirring the toner and a carrier and transporting the mixture to the development roller 22. The agitator may be an auger, and a plurality of the agitators may be prepared in the process cartridge 2.

The exposure unit 13 forms the electrostatic latent image on the photoconductive drum 21 by irradiating light modulated according to image information to the photoconductive drum 21. The exposure unit 13 may be a laser scanning unit (LSU) using a laser diode as a light source, or a light-emitting diode (LED) exposure unit using an LED as a light source.

The transfer roller 14 is an example of a transfer unit for transferring a toner image from the photoconductive drum 21 to the recording medium P. A transfer bias voltage for transferring the toner image to the recording medium P is applied to the transfer roller 14. A corona transfer unit or a transfer unit using a pin scorotron method may be used instead of the transfer roller 14.

The recording media P are picked up one by one from a loading table 17 by a pickup roller 16, and are transferred by feed rollers 18-1 and 18-2 to a region where the photoconductive drum 21 and the transfer roller 14 face each other.

The fusing unit 15 applies heat and pressure to an image transferred to the recording medium P so as to fuse the image on the recording medium P. The recording medium P that passed through the fusing unit 15 is discharged to the outside of the main body 1 by a discharge roller 19.

According to the above structure, the exposure unit 13 irradiates the light modulated according to the image information to the photoconductive drum 21 to develop the electrostatic latent image. The development roller 22 supplies the toner to the electrostatic latent image to form the visible toner image on the surface of the photoconductive drum 21. The recording medium P loaded in the loading table 17 is transferred by the pickup roller 16 and the feed rollers 18-1 and 18-2 to the region where the photoconductive drum 21 and the transfer roller 14 face each other, and the toner image is transferred to the recording medium P from the photoconductive drum 21 according to the transfer bias voltage applied to the transfer roller 14. After the recording medium P passes through the fusing unit 15, the toner image is fused on the recording medium P according to heat and pressure. After the fusing, the recording medium P is discharged by the discharge roller 19.

The process cartridge 2 may have a first structure divided into an imaging cartridge 400 including the photoconductive drum 21 and the development roller 22 and a toner cartridge 100 including the toner containing unit 101, a second structure divided into a photoreceptor cartridge 200 including the photoconductive drum 21, a development cartridge 300 including the development roller 22, and a toner cartridge 100 including the toner containing unit 101, a third structure divided into a photoreceptor cartridge 200 and a development cartridge 300 including the toner containing unit 101, or a fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in the main body 1, the toner cartridge 100 is connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) are connected to each other.

Figure 3A:
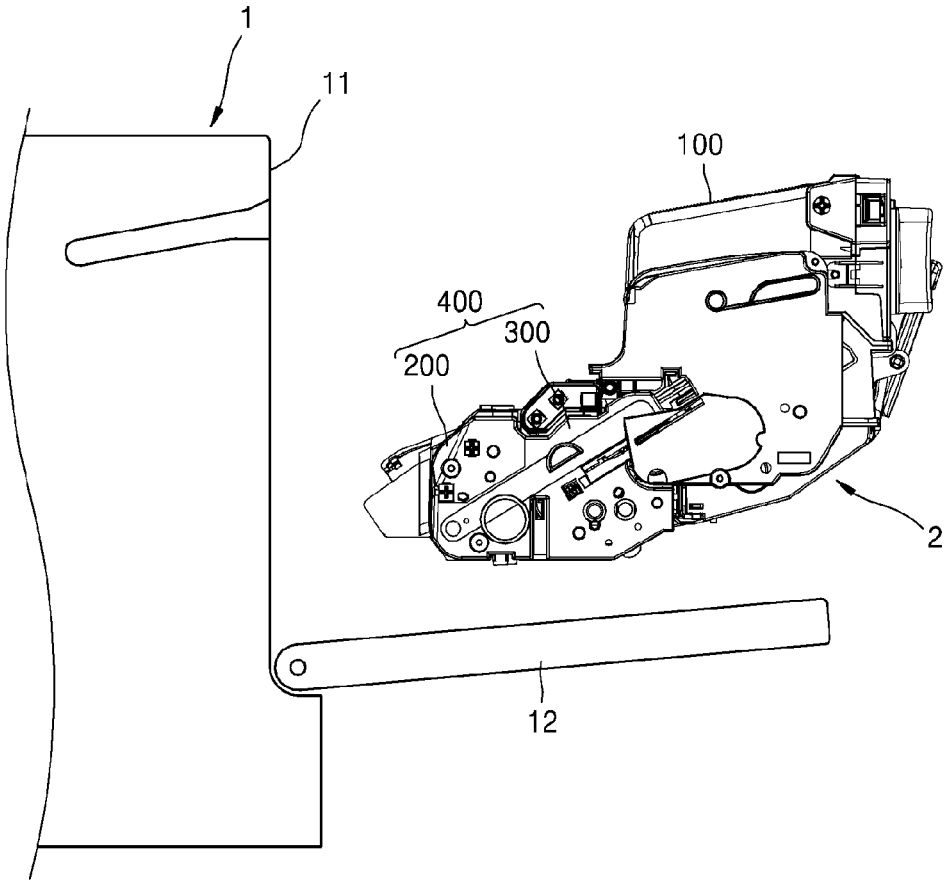
FIG. 3A illustrates replacement of a process cartridge.
Figure 3B:
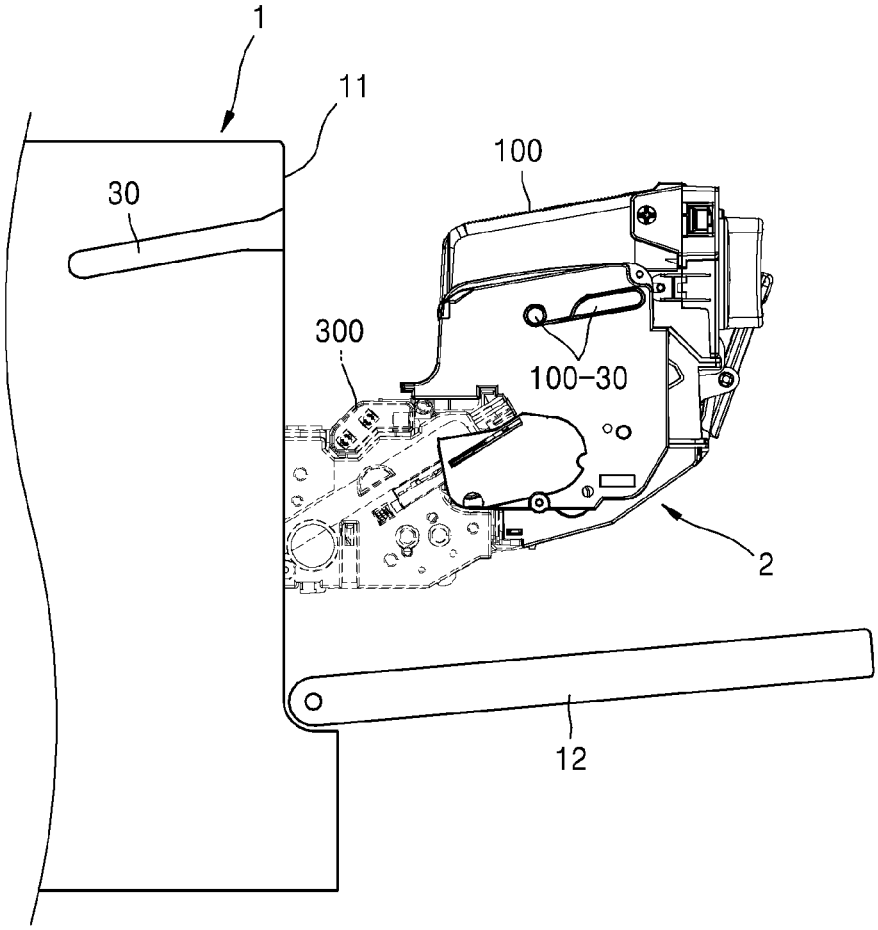
FIG. 3B illustrates replacement of a toner cartridge.

The process cartridge 2 is a consumable product that is replaced after its life is expired. The process cartridge 2 is attached to or detached from the main body 1 via an opening portion 11. In the case of the process cartridge 2 having the fourth structure, when toner contained in the toner containing unit 101 is consumed completely, the process cartridge 2 as a whole is replaced as illustrated in FIG. 3A. In general, the life of the imaging cartridge 400 is longer than the life of the toner cartridge 100. By using the process cartridge 2 having the first structure, the second structure or the third structure, the toner cartridge 100 or the development cartridge 300 in which the toner containing unit 101 is integrally formed may be individually replaced as illustrated in FIG. 3B, and thus, costs for replacement of consumables may be reduced. The process cartridge 2 according to the current embodiment has the first structure. Referring to FIG. 3B, a guide rail 30 that guides the toner cartridge 100 is included in the main body 1, and a guide protrusion 100-30 into which the guide rail 30 is inserted may be formed on the toner cartridge 100.

Figure 4:
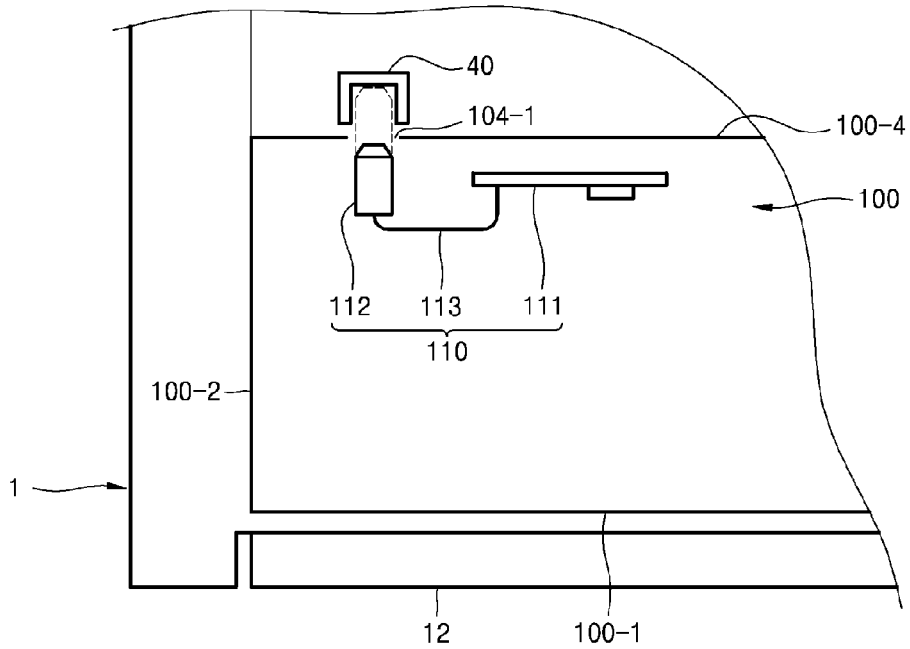
FIG. 4 is a partial plan view of an image forming apparatus according to an embodiment, illustrating a structure in which a contact portion is moved.
Figure 5:
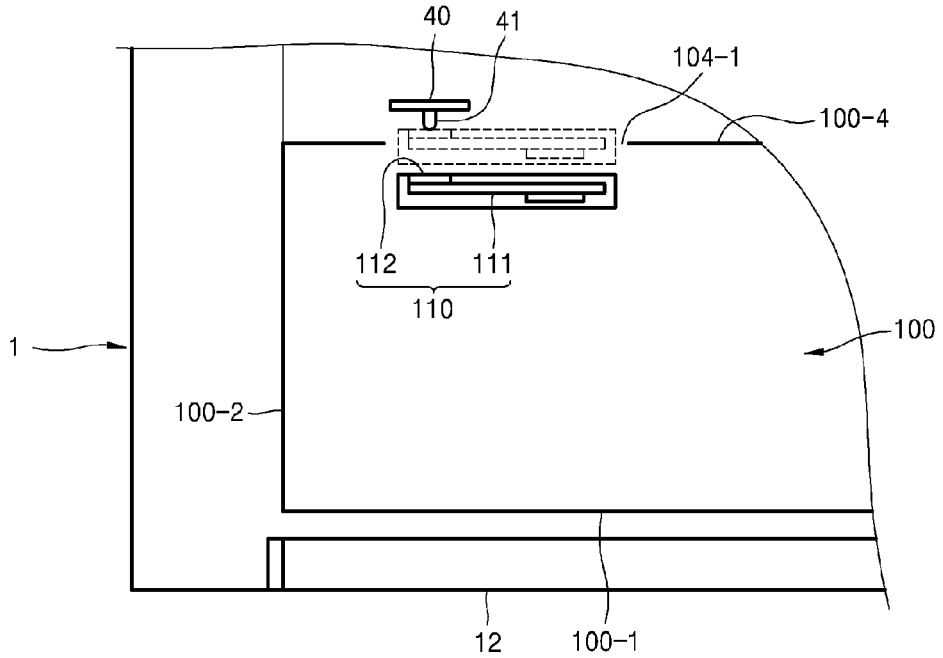
FIG. 5 is a partial plan view of an image forming apparatus according to an embodiment, illustrating a structure in which a memory unit including a contact portion is moved.

FIGS. 4 and 5 are partial plan views of the image forming apparatus according to an embodiment. Referring to FIGS. 4 and 5, the memory unit 110 is included in the toner cartridge 100. When the toner cartridge 100 is mounted in the main body 1, the memory unit 110 is electrically connected to the main body 1 to transmit information of the toner cartridge 100 to the main body 1. The main body 1 may determine whether the toner cartridge 100 is mounted, by determining whether the memory unit 110 is electrically connected to the main body 1, for example, by determining whether communication with the memory unit 110 is possible or not.

The memory unit 110 may include a circuit unit 111 to monitor or manage a state of the toner cartridge 100 and a contact portion 112 via which the memory unit 110 is connected to the main body 1. The circuit unit 111 may include a customer replaceable unit monitor (CRUM) unit including a central processing unit (CPU) that performs at least one of authentication and/or coding of data communication with respect to the main body 1 by using, for example, an operating system (OS) included in the circuit unit 111. The circuit unit 111 may further include a memory. The memory may store various types of information about the toner cartridge 100. For example, specific information such as manufacturer information, manufacture date information, a serial number, or a model number, various programs, electronic signature information, and usage state (for example, a number of pages printed so far, a number of remaining printable pages, or an amount of toner left). Also, the memory may store even the lifetime or setup menus of the toner cartridge 100. In addition, the circuit unit 111 may include a functional block capable of performing various functions for communication, authentication, or coding. The circuit unit 111 may be in the form of a chip including a CPU, a chip including a memory and a CPU, or a printed circuit board on which chips and circuit elements for implementing various functional blocks are mounted.

The contact portion 112 may be connected to the circuit unit 111 via a signal line 113 as illustrated in FIG. 4. The contact portion 112 may be, for example, in the form of a modular jack. A connection portion 40 that is connected to the contact portion 112 is included in the main body 1. The connection portion 40 may be in the form of a modular connector into which the contact portion 112 in the form of a modular jack is inserted.

As illustrated in FIG. 5, the memory unit 110 may be in the form of a package in which the circuit unit 111 is mounted and from which the contact portion 112 is exposed to the outside. In this case, the contact portion 112 may include a conductive pattern that is exposed to the outside of a package. The connection portion 40 may include a pin type terminal that is electrically connectable to the contact portion 112 which is in the form of a conductive pattern.

Also, the contact portion 112 may be in the form of a conductive pattern. The contact portion 112 in the form of a conductive pattern may be formed on a circuit board which is not shown, or may be integrally formed with a printed circuit board of the circuit unit 111. In this case, the connection portion 40 may include a pin type terminal 41 that is electrically connectable to the contact portion 112 which is in the form of a conductive pattern. Also, the contact portion 112 may be a pin type terminal, and the connection portion 40 may be in the form of a conductive pattern to which the pin type terminal is connected. Alternatively, the contact portion 112 and the connection portion 40 may have various forms whereby they may be electrically connected to each other.

As illustrated in FIGS. 4 and 5 by a dotted line, when the contact portion 112 is protruded out of the toner cartridge 100, the contact portion 112 may be polluted or damaged when handling the toner cartridge 100. Also, when mounting the toner cartridge 100 in the main body 1, the contact portion 112 may be damaged due to collision with the main body 1. Damage to or pollution of the contact portion 112 may be the cause of a contact defect between the contact portion 112 and the connection portion 40.

To solve this problem, the memory unit 110 includes the contact portion 112 that is movable to a first position (illustrated in FIGS. 4 and 5 by a solid line) that is hidden inside the toner cartridge 100 and a second position (illustrated in FIGS. 4 and 5 by a dotted line) that is protruded from the toner cartridge 100. According to the embodiment of FIG. 4, only the contact portion 112 is moved, and according to the embodiment of FIG. 5, the memory unit 110 that is in the form of a package and includes the contact portion 112 is moved. A protruding direction of the contact portion 112 at the second position is not limited. The contact portion 112 may be protruded in various directions, for example, toward a rear portion 100-1, a side portion 100-2, a front portion 100-4, or an upper portion, of the toner cartridge 100. Hereinafter, an embodiment will be described in which the contact portion 112 is protruded toward the front portion 100-4 of the toner cartridge 100.

According to the image forming apparatus of the current embodiment, the contact portion 112 is moved from the first position to the second position via an operation of mounting the toner cartridge 100 in the main body 1.

Figure 6:
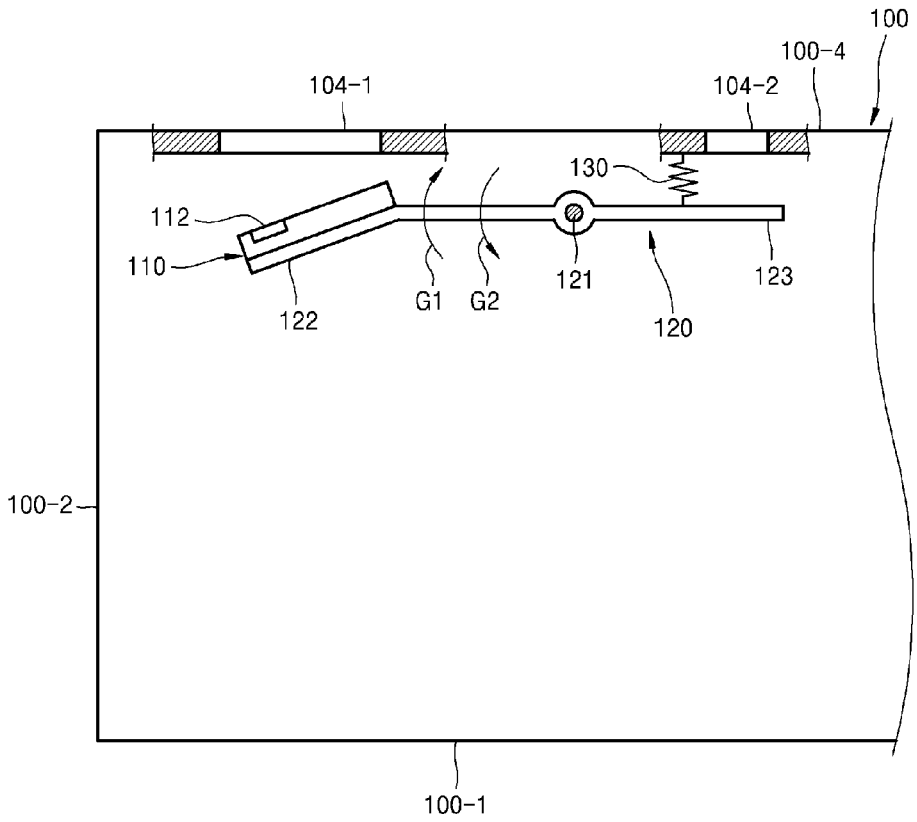
FIG. 6 is a schematic plan view of a toner cartridge having a structure for moving a contact portion to first and second positions, according to an embodiment.
Figure 7:
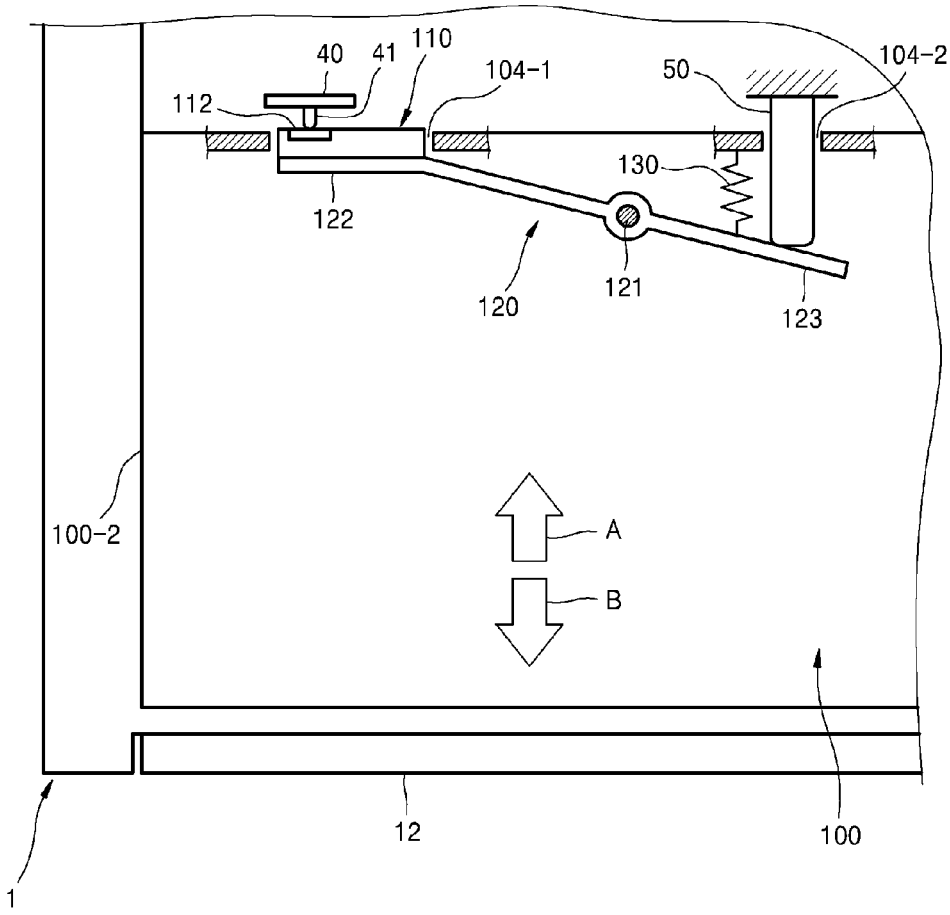
FIG. 7 is a schematic plan view of an image forming apparatus according to an embodiment, wherein the toner cartridge illustrated in FIG. 6 is mounted in a main body.

FIG. 6 is a schematic plan view of the toner cartridge 100 having a structure for moving the contact portion 112 to first and second positions, according to an embodiment. FIG. 7 is a schematic plan view of an image forming apparatus according to an embodiment, wherein the toner cartridge 100 illustrated in FIG. 6 is mounted in the main body 1.

Referring to FIGS. 6 and 7, the toner cartridge 100 includes a moving member 120. The contact portion 112 is mounted on the moving member 120. To move the contact portion 112 to the first and second positions, the moving member 120 is moved by interference with an interference member 50 provided in the main body 1 as the toner cartridge 100 is mounted in the main body 1. The moving member 120 is pivotably installed on the toner cartridge 100 with respect to a pivoting shaft 121. The memory unit 110 is mounted at a first end portion 122 of the moving member 120. When the moving member 120 is pivoted with respect to the pivoting shaft 121 in a direction G1, the contact portion 112 of the memory unit 110 is moved to the second position that is exposed to the outside through a first exit 104-1 formed at the front portion 100-4 of the toner cartridge 100. When the moving member 120 is pivoted with respect to the pivoting shaft 121 in a direction G2, the contact portion 112 of the memory unit 110 returns to the first position accommodated inside the toner cartridge 100. A first elastic member 130 provides an elastic force to the moving member 120 such that the contact portion 112 is pivoted in a direction to return to the first position.

The interference member 50 by which to pivot the moving member 120 is provided in the main body 1. For example, as the toner cartridge 100 is mounted in the main body 1, the interference member 50 enters the toner cartridge 100 through a second exit 104-2 formed at the toner cartridge 100 to push a second end portion 123 of the moving member 120 to thereby pivot the moving member 120 in the direction G1. That is, the interference member 50 pivots the moving member 120 in an opposite direction of an elastic force of the first elastic member 130.

When the toner cartridge 100 is separated from the main body 1, the contact portion 112 is located at the first position due to an elastic force of the first elastic member 130 as illustrated in FIG. 6. As the contact portion 112 is located inside the toner cartridge 100, pollution of or damage to the contact portion 112 when handling the toner cartridge 100 may be reduced. Also, as the toner cartridge 100 is mounted in the main body 1 when the contact portion 112 is located at the first position, damage to the toner cartridge 100 due to collision between the main body 1 and the contact portion 112 may be reduced.

The door 12 is opened and the guide protrusion 100-30 of the toner cartridge 100 is inserted into the guide rail 30 provided in the main body 1, and the toner cartridge 100 is pushed into the main body 1 along the guide rail 30 in the mounting direction A. The front portion 100-4 of the toner cartridge 100 approaches the interference member 50, and the interference member 50 enters the toner cartridge 100 through the second exit 104-2 and contacts the second end portion 123 of the moving member 120. As the toner cartridge 100 is inserted further, the moving member 120 is pushed by the interference member 50 so as to be pivoted with respect to the pivoting shaft 121 in the direction G1, and the contact portion 112 approaches the first exit 104-1. When mounting of the toner cartridge 100 is completed, the contact portion 112 is exposed to the outside of the toner cartridge 100 through the first exit 104-1 and is electrically connected to the connection portion 40.

As described above, as the contact portion 112 is moved to the second position and the memory unit 110 is electrically connected to the main body 1 via an operation of mounting the toner cartridge 100 in the main body 1, a connection error between the toner cartridge 100 and the main body 1 is not caused. Accordingly, operational reliability of the image forming apparatus may be improved. Also, the user has just to mount the toner cartridge 100 in the main body 1 and does not have to consider whether there is an electrical connection error between the toner cartridge 100 and the main body 1, and thus, user convenience may be increased.

To detach the toner cartridge 100 from the main body 1, the door 12 is opened and the toner cartridge 100 is pulled in a detaching direction B. As the toner cartridge 100 is moved in the detaching direction B, the interference member 50 is moved away from the toner cartridge 100, and the moving member 120 is pivoted in the direction G2 due to an elastic force of the first elastic member 130. The contact portion 112 is separated from the connection portion 40. When interference between the interference member 50 and the moving member 120 is ended, the contact portion 112 returns to the first position accommodated inside the toner cartridge 100.

Figure 8:
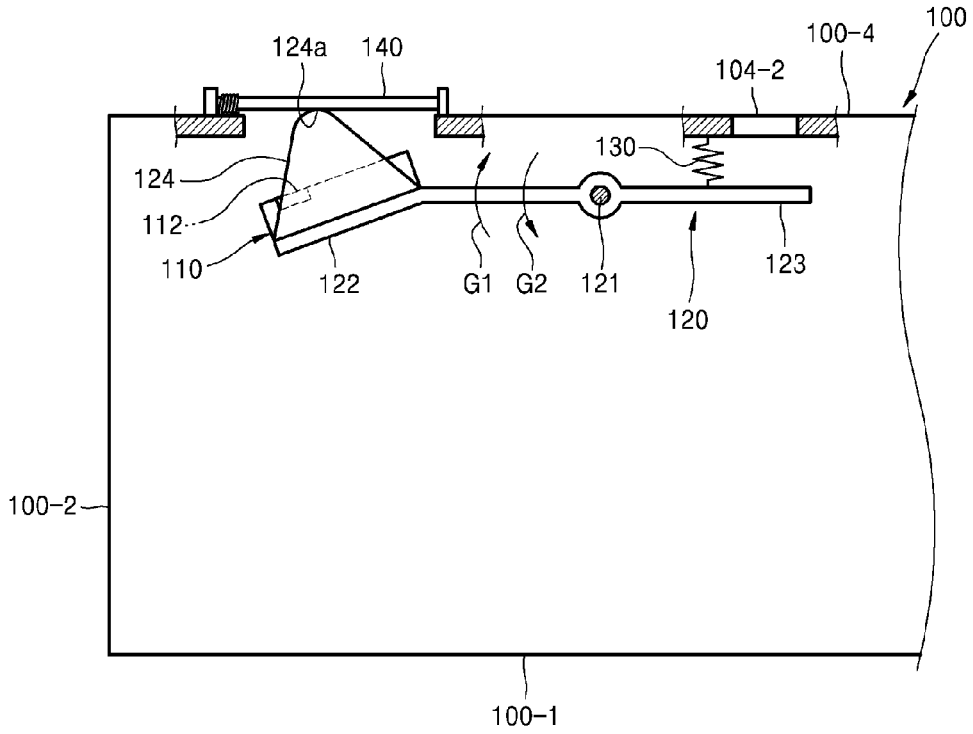
FIG. 8 is a plan view of a toner cartridge including a shutter according to an embodiment.
Figure 9:
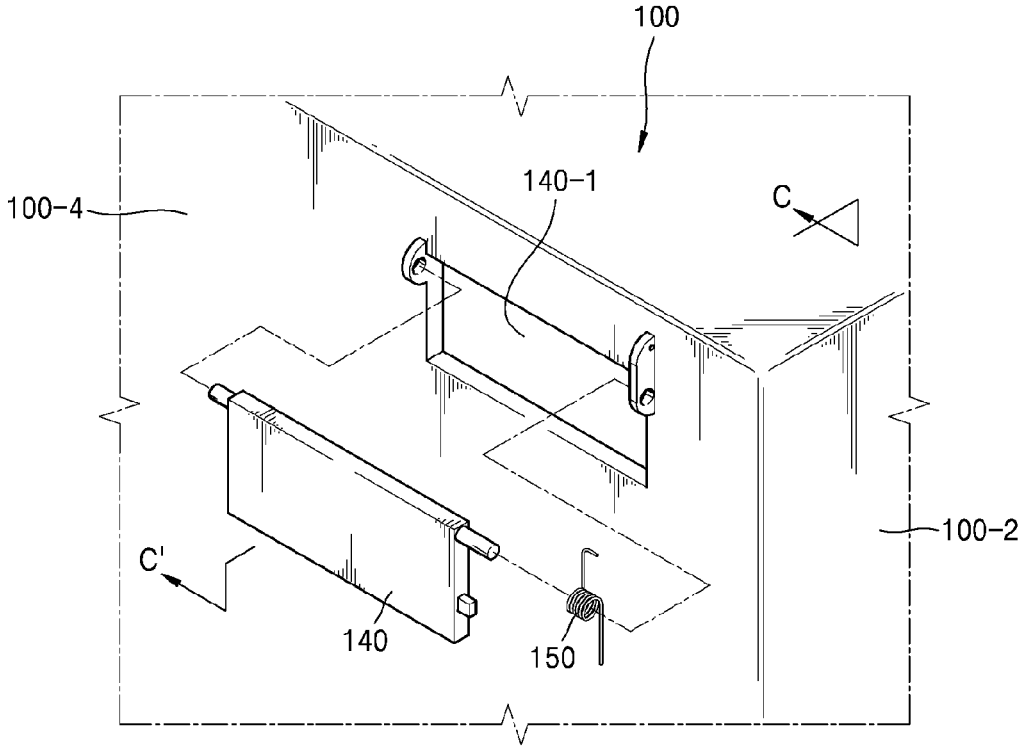
FIG. 9 is a partial perspective view of the toner cartridge of FIG. 8.
Figure 10A:
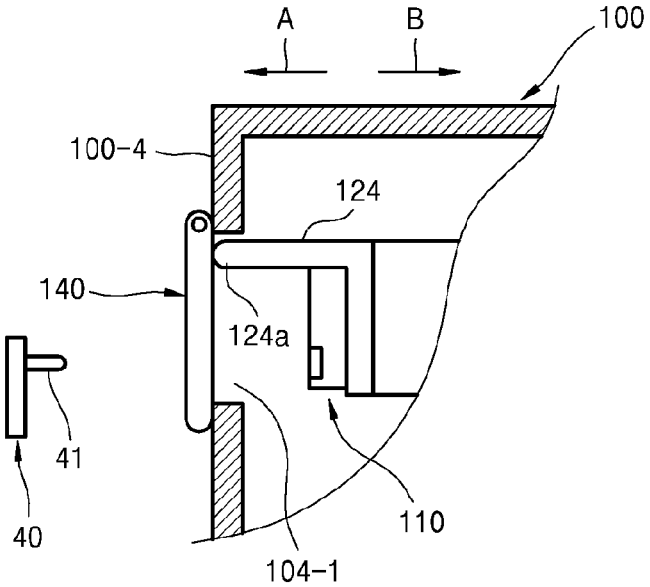
FIGS. 10A, 10B, and 10C are cross-sectional views of a portion of the toner cartridge 100 of FIG. 9 cut along a line C-C', respectively showing the shutter being moved from a position where the first exit is closed to a position where the first exit is opened.
Figure 10B:
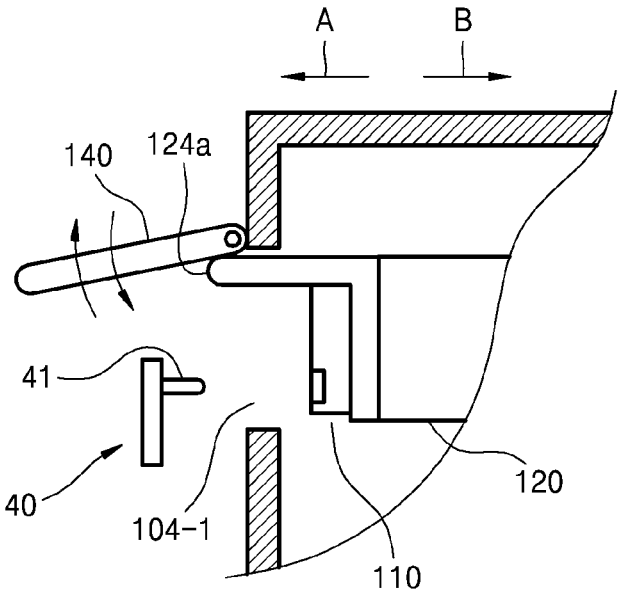
Figure 10C:
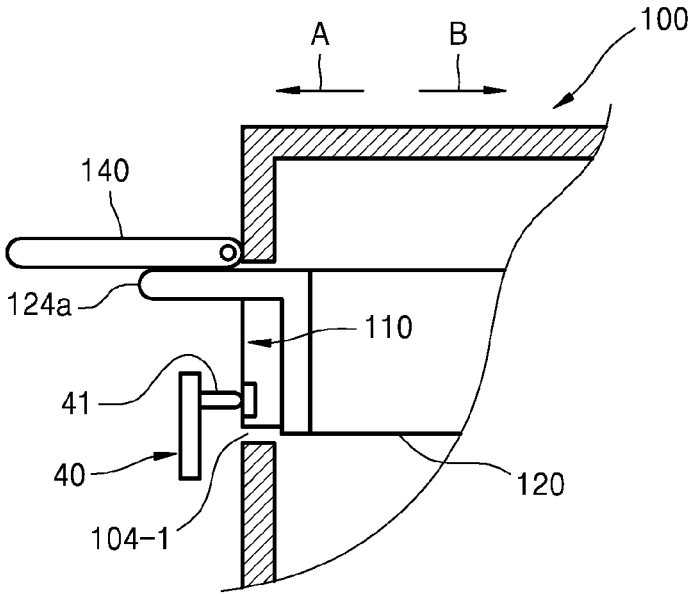

FIG. 8 is a plan view of the toner cartridge 100 including a shutter 140 according to an embodiment. FIG. 9 is a partial perspective view of the toner cartridge 100 of FIG. 8. FIGS. 10A, 10B, and 10C are cross-sectional views of a portion of the toner cartridge 100 of FIG. 9 cut along a line C-C', respectively showing the shutter 140 being moved from a position where the first exit 104-1 is closed to a position where the first exit 104-1 is open.

Referring to FIGS. 8, 9, 10A, 10B, and 100, the toner cartridge 100 further includes the shutter 140 that opens or closes the first exit 104-1. The shutter 140 may be pivotably installed, for example, at the front portion 100-4 of the toner cartridge 100. The shutter 140 is pivoted between a position where the first exit 104-1 is open and a position where the first exit 104-1 is closed, in connection with pivoting of the moving member 120. The second elastic member 150 applies an elastic force to the shutter 140 such that the shutter 140 is pivoted in a direction to close the first exit 104-1.

An interference arm 124 via which to open the shutter 140 is formed at the moving member 120. An end portion 124*a* of the interference arm 124 is protruded toward the front portion 100-4 further than the contact portion 112. An amount of protrusion of the end portion 124*a* of the interference arm 124 with respect to the memory unit 110 may be determined in such a manner that the shutter 140 is completely opened before the contact portion 112 reaches the second position.

When the toner cartridge 100 is separated from the main body 1, the contact portion 112 is located at the first position as illustrated in FIG. 8 due to an elastic force of the first elastic member 130, and the shutter 140 is located at a position where the first exit 104-1 is closed as illustrated in FIG. 10A. Accordingly, penetration of foreign substances into the toner cartridge 100 through the first exit 104-1 may be prevented, and pollution of and damage to the contact portion 112 due to foreign substances may be reduced.

When the toner cartridge 100 is inserted into the main body 1, the interference member 50 contacts the second end portion 123 of the moving member 120, and the moving member 120 starts to pivot in the direction G1. As the moving member 120 is pivoted in the direction G1, the shutter 140 is pushed by the interference arm 124 to be moved to a position where the first exit 104-1 is opened. As illustrated in FIG. 10B, the shutter 140 is located at a position where the first exit 104-1 is completely opened before the contact portion 112 reaches the second position. Accordingly, the shutter 140 may not contact the connection portion 40 formed in the main body 1 during pivoting. When insertion of the toner cartridge 100 is completed, the contact portion 112 reaches the second position and is electrically connected to the connection portion 40 as illustrated in FIG. 100.

An operation of detaching the toner cartridge 100 is in a reverse order to the above described order. As the toner cartridge 100 is moved in the detaching direction B, the moving member 120 is pivoted in the direction G2 due to an elastic force of the first elastic member 130. As illustrated in FIG. 10B, until the toner cartridge 100 is separated from the connection portion 40 by a predetermined distance, the shutter 140 remains located at a position where the first exit 104-1 is opened. Then, when the toner cartridge 100 escapes further in the detaching direction B, the shutter 140 is pivoted by the elastic force of the second elastic member 150 to return to the position where the first exit 104-1 is closed as illustrated in FIG. 10A, and the contact portion 112 returns to the first position.

Figure 11:
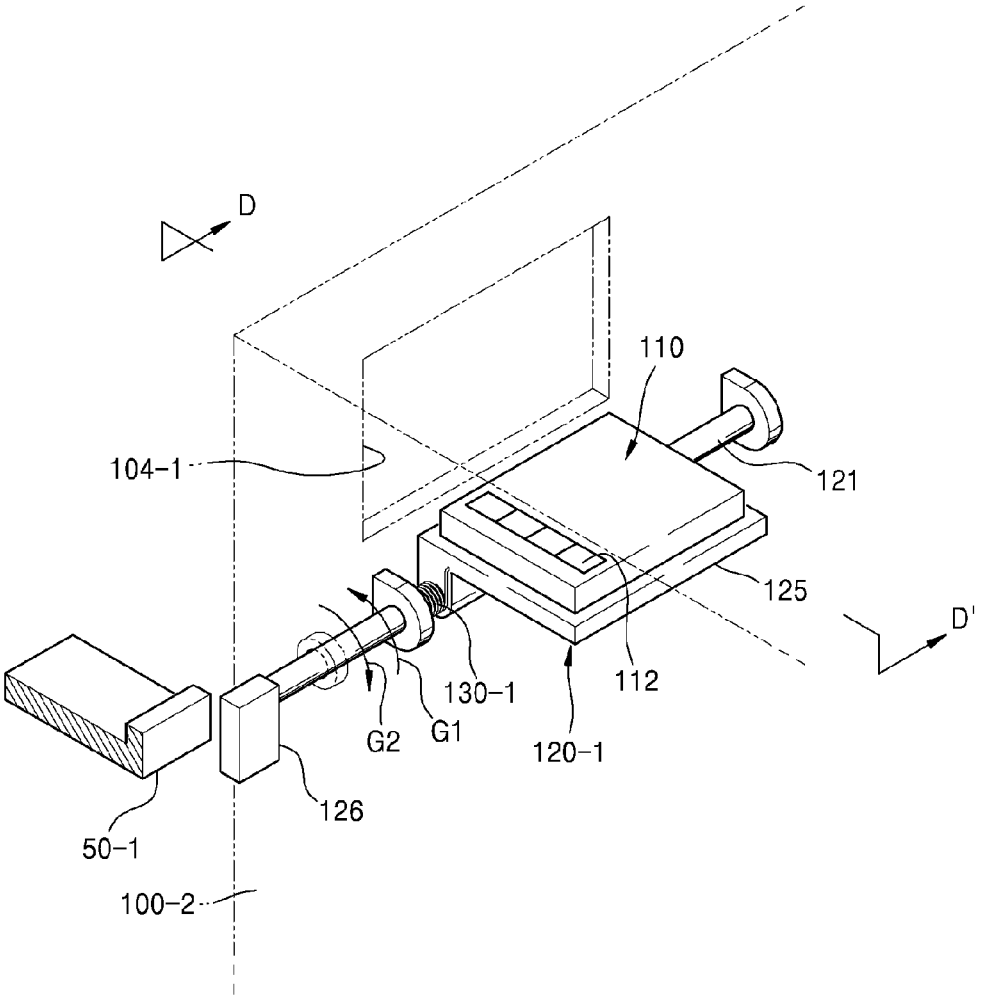
FIG. 11 is a partial perspective view of the toner cartridge according to an embodiment.
Figure 12A:
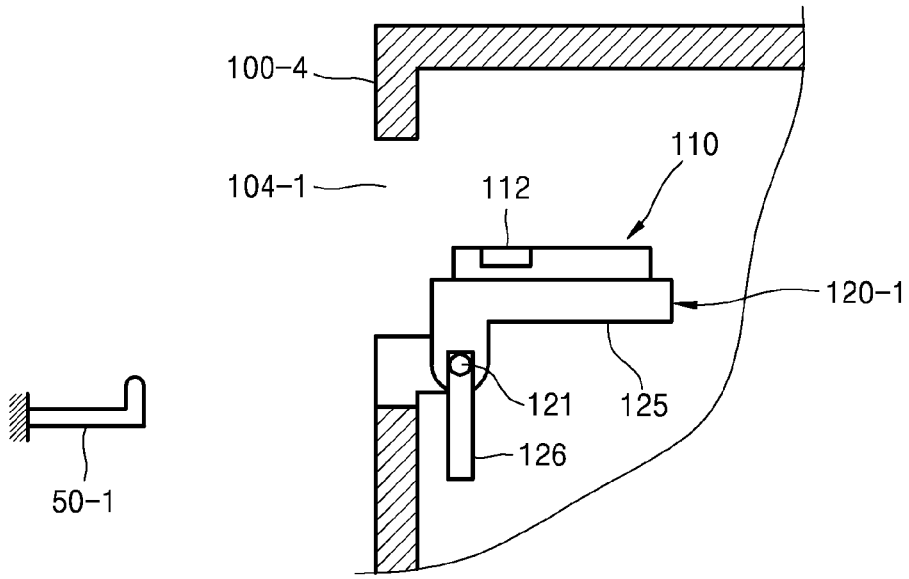
FIGS. 12A and 12B are cross-sectional views of the toner cartridge of FIG. 11 cut along a line D-D', respectively showing the contact portion located at the first and second positions.
Figure 12B:
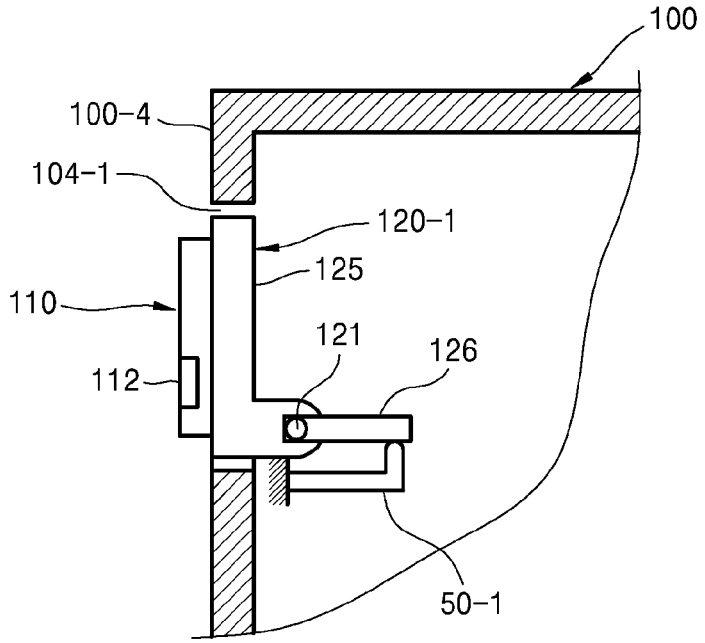

FIG. 11 is a partial perspective view of the toner cartridge 100 according to an embodiment. FIGS. 12A and 12B are cross-sectional views of the toner cartridge 100 of FIG. 11 cut along a line D-D', respectively showing the contact portion 112 located at the first and second positions.

Referring to FIGS. 11, 12A, and 12B, a moving member 120-1 includes a pivoting shaft 121 and a mounting portion 125 that is connected to the pivoting shaft 121 and on which the memory unit 110 including the contact portion 112 is mounted. One end portion of the pivoting shaft 121 is protruded from the side portion 100-2 of the toner cartridge 100, and a lever 126 is formed at an end of the one end portion. The lever 126 is eccentrically located from the pivoting shaft 121.

The lever 126 contacts an interference member 50-1 provided in the main body 1 when the toner cartridge 100 is mounted in the main body 1. Accordingly, the moving member 120-1 is pivoted in the direction G1, and the contact portion 112 is moved to the second position as illustrated in FIG. 12B. A first elastic member 130-1 applies an elastic force to the moving member 120-1 such that the moving member 120-1 is pivoted in the direction G2. Accordingly, when the toner cartridge 100 is detached from the main body 1, contact between the interference member 50-1 and the lever 126 is ended, and the moving member 120-1 is pivoted in the direction G2 due to an elastic force of the first elastic member 130-1, and the contact portion 112 returns to the first position as illustrated in FIG. 12A.

Figure 13:
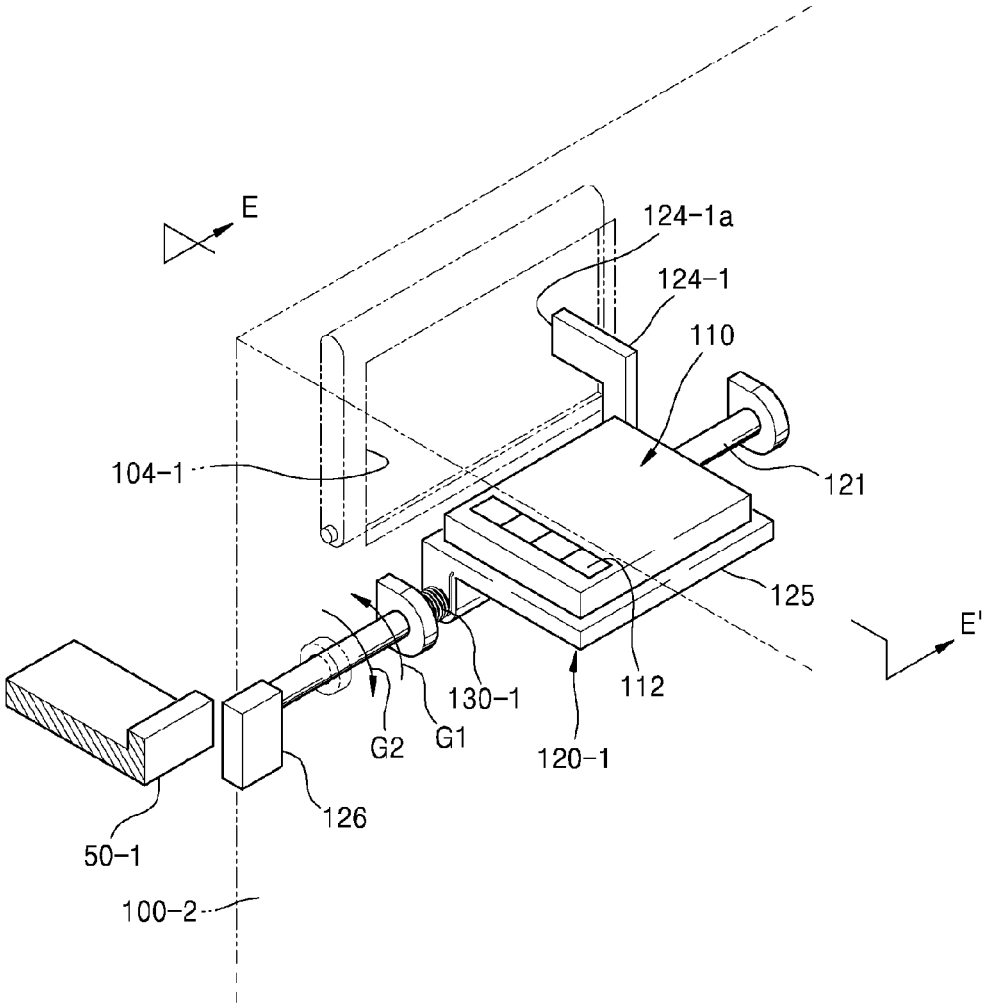
FIG. 13 is a partial perspective view of a toner cartridge including a shutter, according to an embodiment.
Figure 14A:
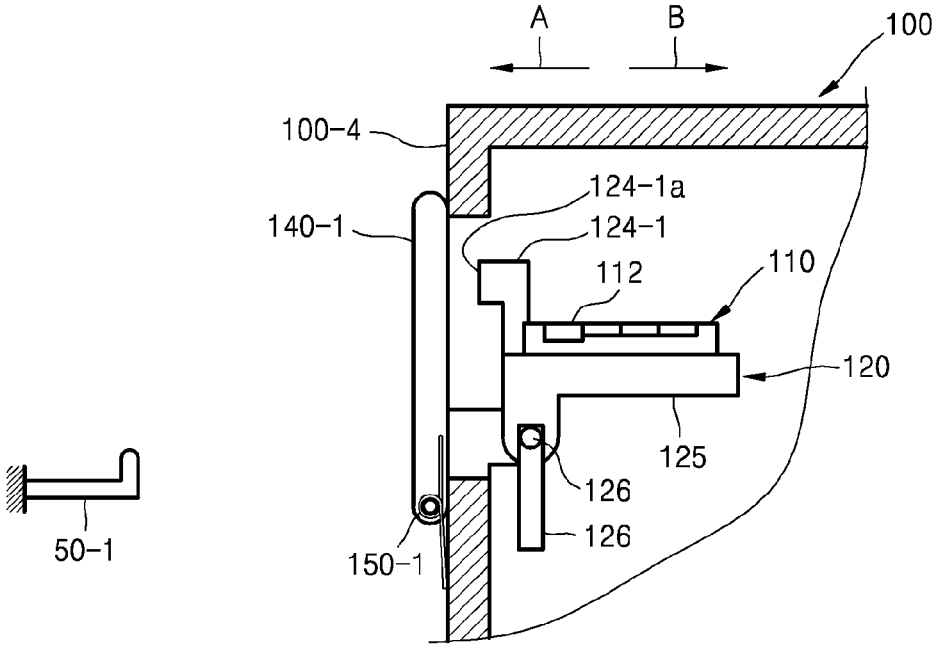
FIGS. 14A and 14B are cross-sectional views of the toner cartridge cut along a line E-E', respectively showing the contact portion located at the first and second positions.
Figure 14B:
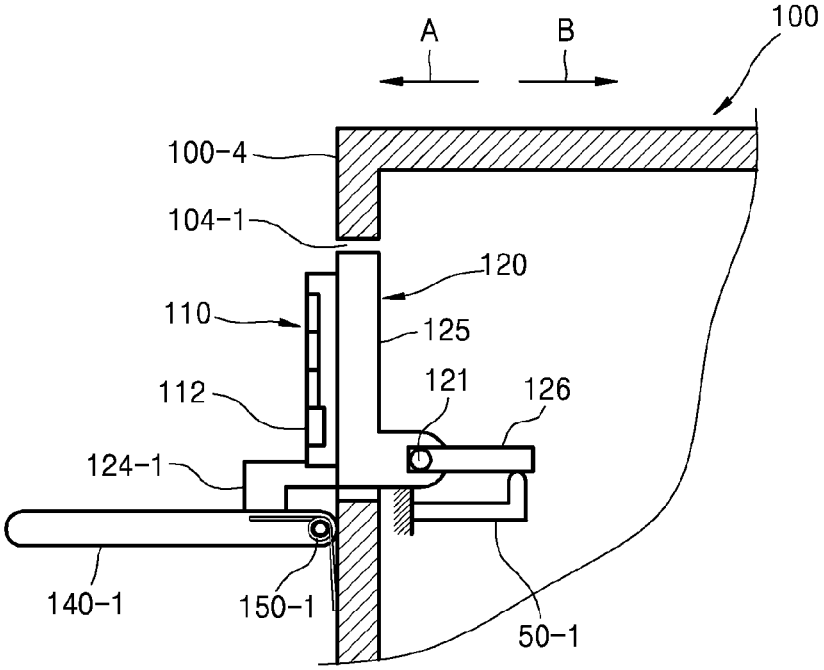

FIG. 13 is a partial perspective view of the toner cartridge 100 according to embodiment. FIGS. 14A and 14B are cross-sectional views of the toner cartridge 100 cut along a line E-E', respectively showing the contact portion 112 located at the first and second positions. The toner cartridge 100 illustrated in FIGS. 13, 14A, and 14B is different from the toner cartridge 100 of FIGS. 11, 12A, and 12B in that a shutter 140-1 that opens or closes the first exit 104-1 is included.

Referring to FIGS. 13, 14A, and 14B, the toner cartridge 100 further includes the shutter 140-1 that opens or closes the first exit 104-1. The shutter 140-1 may be pivotably installed, for example, at the front portion 100-4 of the toner cartridge 100. The shutter 140-1 is pivoted between a position where the first exit 104-1 is opened and a position where the first exit 104-1 is closed, in connection with pivoting of the moving member 120-1. The second elastic member 150-1 applies an elastic force to the shutter 140-1 such that the shutter 140-1 is pivoted in a direction to close first exit 104-1. An interference arm 124-1 by which to open the shutter 140-1 is formed at the moving member 120-1. An end portion 124-1 a of the interference arm 124-1 is protruded toward the front portion 100-4 further than the contact portion 112.

When the toner cartridge 100 is separated from the main body 1, the contact portion 112 is located at the first position due to an elastic force of the first elastic member 130-1 as illustrated in FIG. 14A, and the shutter 140-1 is located at a position where the first exit 104-1 is closed. When the toner cartridge 100 is inserted into the main body 1, the interference member 50-1 contacts the lever 126 of the moving member 120-1, and the moving member 120-1 is pivoted in the direction G1, and the shutter 140-1 is pushed by the interference arm 124-1 to be moved to a position where the first exit 104-1 is opened. The shutter 140-1 is located at a position where the first exit 104-1 is completely opened, before the contact portion 112 reaches the second position. When insertion of the toner cartridge 100 is completed, the contact portion 112 reaches the second position as illustrated in FIG. 14B and is electrically connected to the connection portion 40.

When the toner cartridge 100 starts to escape in the detaching direction B, the moving member 120-1 is pivoted in the direction G2, and until the toner cartridge 100 is separated from the connection portion 40 to some extent, the shutter 140-1 is maintained at a position where the first exit 104-1 is opened. Then when the toner cartridge 100 escapes further in the detaching direction B, the shutter 140-1 is pivoted by an elastic force of the second elastic member 150-1 and returns to a position where the first exit 104-1 is closed as illustrated in FIG. 14A, and the contact portion 112 returns to the first position.

According to the above-described embodiments, a structure is used, in which the contact portion 112 is moved to the first and second positions as the moving member 120 or 120-1 on which the memory unit 110 is mounted is pivoted by interference with the interference member 50 or 50-1 provided in the main body 1 when the toner cartridge 100 is mounted in the main body 1. That is, the contact portion 112 is moved to the first and second positions according to an arc shaped moving track.

Figure 15:
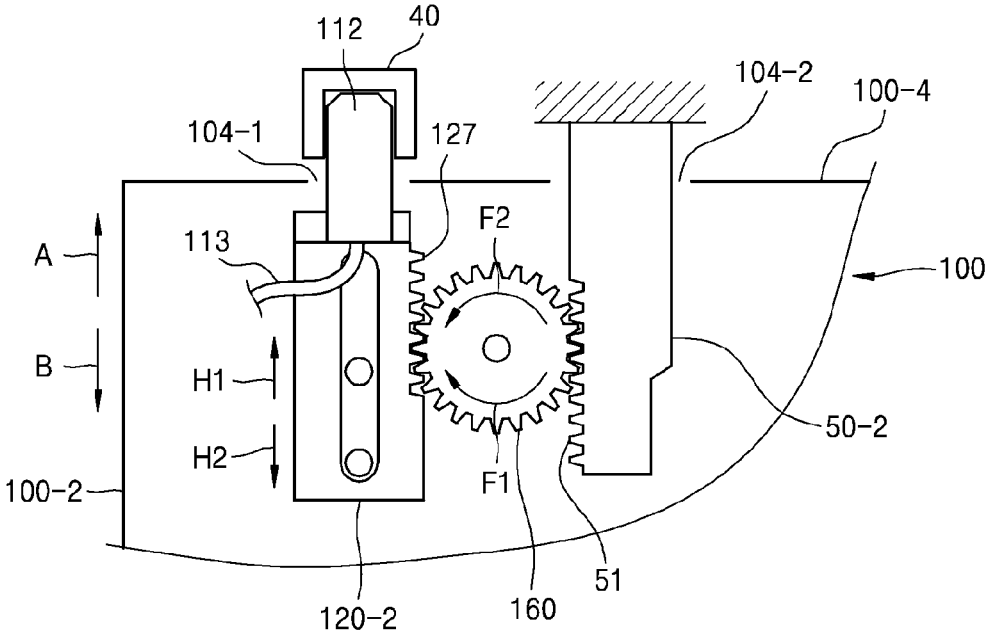
FIG. 15 is a schematic plan view of a toner cartridge according to an embodiment.

The contact portion 112 may also be moved to the first and second positions according to a straight moving track. To this end, the toner cartridge 100 illustrated in FIGS. 6 and 7 may be modified in a form as illustrated in FIG. 15. FIG. 15 is a schematic plan view of the toner cartridge 100 according to an embodiment.

Referring to FIG. 15, the contact portion 112 is separated from the circuit unit 111 (not shown) and is mounted on a moving member 120-2. The contact portion 112 may be, for example, in the form of a modular jack. The connection portion 40 is in the form of a modular connector into which the contact portion 112 in the form of a modular jack is inserted. The contact portion 112 is connected to the circuit unit 111 (not shown) via a signal line 113. Alternatively, the circuit 111 may be mounted on the moving member 120-2. A rack gear 127 is formed on the moving member 120-2. A rack gear 51 is formed on an interference member 50-2 provided in the main body 1. A pinion 160 is interposed between the rack gears 127 and 51.

According to the above structure, when the toner cartridge 100 is inserted into the main body 1 in the mounting direction A, the rack gear 51 of the interference member 50-2 is inserted into the toner cartridge 100 through the second exit 104-2 so as to be engaged with the pinion 160. The pinion 160 is rotated in a direction F1, and rotation of the pinion 160 is converted into linear movement of the moving member 120-2 via the rack gear 127. The moving member 120-2 is moved in a direction H1, and the contact portion 112 reaches the second position where the contact portion 112 is connected to the connection portion 40. By pulling the toner cartridge 100 in the detaching direction B, the pinion 160 is rotated in a direction F2, and the moving member 120-2 is moved in a direction H2. Accordingly, the contact portion 112 returns to the first position accommodated inside the toner cartridge 100.

Figure 16:
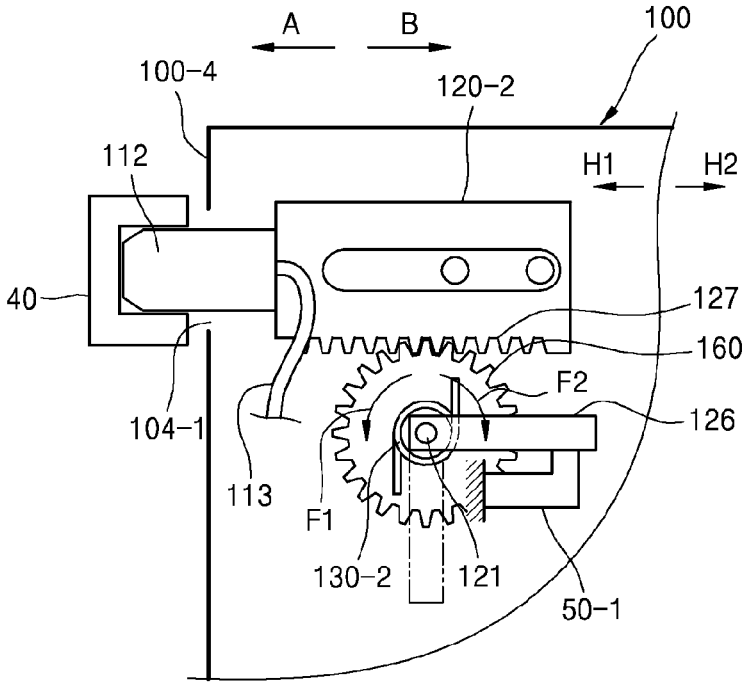
FIG. 16 is a schematic plan view of a toner cartridge according to an embodiment.

To move the contact portion 112 to the first and second positions according to a straight moving track, the toner cartridge 100 illustrated in FIG. 11 may be modified with the toner cartridge 100 as illustrated in FIG. 16. FIG. 16 is a schematic plan view of the toner cartridge 100 according to an embodiment.

Referring to FIG. 16, the contact portion 112 is separated from the circuit unit 111 (not shown) and is mounted on the moving member 120-2, and is connected to the circuit unit 111 (not shown) via a signal line 113. Alternatively, the circuit 111 may be mounted on the moving member 120-2. A rack gear 127 is formed on the moving member 120-2.

One end portion of the pivoting shaft 121 is protruded from the side portion 100-2 of the toner cartridge 100, and a lever 126 is formed at an end portion of the one end portion. The lever 126 is eccentrically located from the pivoting shaft 121. A pinion 160 is installed at the other end portion of the pivoting shaft 121. The pinion 160 is engaged with the rack gear 127. An elastic member 130-2 applies an elastic force to the pivoting shaft 121 or the pinion 160 such that the pivoting shaft 121 or the pinion 160 is rotated in a direction to return the contact portion 112 to the first position. The lever 126 is interfered with the interference member 50-1 formed on the main body 1 when the toner cartridge 100 is mounted in the main body 1. According to the above structure, when the toner cartridge 100 is inserted into the main body 1 in the mounting direction A, the interference member 50-1 pushes the lever 126, and the pivoting shaft 121 is rotated. The pinion 160 is rotated in the direction F1, and rotation of the pinion 160 is converted into linear movement of the moving member 120-2 via the rack gear 127. The moving member 120-2 is moved in the direction H1, and the contact portion 112 reaches the second position where the contact portion 112 is connected to the connection portion 40. When the toner cartridge 100 is pulled in the detaching direction B, the pinion 160 is rotated in the direction F2 due to an elastic force of the elastic member 130-2, and the moving member 120-2 is moved in the direction H2. Accordingly, the contact portion 112 returns to the first position accommodated inside the toner cartridge 100.

The embodiments in which the contact portion 112 of the memory unit 110 installed in the toner cartridge 100 is moved to the first and second positions in a structure where the toner cartridge 100 is separately replaced from the imaging unit 400 are described above. However, the embodiments are not limited thereto. The structure in which the contact portion 112 is moved to the first or second position may also be applied to the process cartridge 2 having the third structure in which the development cartridge 300 including the toner containing unit 101 is separately replaced from the photoconductor cartridge 200. In this case, the toner cartridge 100 is replaced by the development cartridge 300 in the above-described embodiments. When the development cartridge 300 is mounted in the main body 1, the memory unit 110 is electrically connected to the main body 1 to transmit information of the development cartridge 300 to the main body 1. The memory unit 110 may store various types of information of the development cartridge 300, for example, specific information such as manufacturer information, manufacture date information, a serial number, or a model number, various programs, electronic signature information, and usage state (for example, a number of pages printed so far, a number of remaining printable pages, or an amount of toner left), and even the lifetime and set up menus of the development cartridge 300.

Also, the structure in which the contact portion 112 is moved to the first or second position may be applied to the process cartridge 2 having the fourth structure in which the photoconductor cartridge 200, the development cartridge 300, and the toner cartridge 100 are integrally formed. In this case, the toner cartridge 100 is replaced by the process cartridge 2 in the above-described embodiments. When the process cartridge 2 is mounted in the main body 1, the memory unit 110 is electrically connected to the main body 1 to transmit information of the process cartridge 2 to the main body 1. The memory unit 110 may store various types of information of the process cartridge 2, for example, specific information such as manufacturer information, manufacture date information, a serial number, or a model number, various programs, electronic signature information, and usage state (for example, a number of pages printed so far, a number of remaining printable pages, or an amount of toner left), and even the lifetime and set up menus of the process cartridge 2.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. A cartridge that is attached to or detached from a main body of an image forming apparatus, comprising:

a memory unit that includes a contact portion via which the cartridge is connected to the main body and that is connected to the main body to transmit information of the cartridge to the main body; and a moving member on which the contact portion is mounted, wherein the moving member is moved to a second position where the contact portion is protruded out of the cartridge in order to be connected to a connection portion provided in the main body and a first position where the contact portion is hidden inside the cartridge.

2. The cartridge of claim 1, wherein the moving member is pivoted with respect to a pivoting shaft to be moved to the first and second positions, wherein the cartridge further comprises a first elastic member that applies an elastic force to the moving member so that the moving member returns to the first position.

3. The cartridge of claim 2, wherein the contact portion is mounted at a first end portion of the moving member, wherein when the cartridge is mounted in the main body, a second end portion of the moving member is pushed by an interference member provided in the main body so that the moving member is pivoted with respect to the pivoting shaft so as to be moved to the second position.

4. The cartridge of claim 2, wherein the moving member further comprises:

a mounting portion connected to the pivoting shaft, wherein the contact portion is mounted on the mounting portion; and a lever provided at an end of the pivoting shaft to be exposed to outside of the cartridge, wherein when the cartridge is mounted in the main body, the lever is pushed by the interference member provided in the main body so that the moving member is pivoted with respect to the pivoting shaft so as to be moved to the second position.

5. The cartridge of claim 2, further comprising:

a first exit through which the contact portion goes in and out;

a shutter that opens or closes the first exit; and a second elastic member that provides an elastic force to the shutter in a direction to close the first exit.

6. The cartridge of claim 5, wherein the moving member includes an interference arm to push the shutter to open the first exit when the cartridge is mounted in the main body.

7. The cartridge of claim 1, wherein the moving member is slid to be moved to the first and second positions.

8. The cartridge of claim 7, comprising:

a rack gear formed on the moving member; and a pinion that is engaged with the rack gear and is rotated by an interference member provided in the main body when the cartridge is attached to or detached from the main body.

9. The cartridge of claim 7, comprising:

a pivoting shaft including a lever that is formed at an end portion of the pivoting shaft and is exposed to outside of the cartridge such that the lever is pivoted by being pushed by an interference member provided in the main body when the cartridge is mounted in the main body;

a pinion that is rotated in connection with the pivoting shaft; and a rack gear that is provided on the moving member and is engaged with the pinion.

10. The cartridge of claim 9, further comprising a first elastic member that provides an elastic force so that the pinion is pivoted in a direction in which the moving member returns to the first position.

11. The cartridge of claim 1, further comprising a toner containing unit containing toner.

12. The cartridge of claim 1, further comprising:

a development roller; and a toner containing unit containing toner to be supplied to the development roller.

13. The cartridge of claim 1, further comprising:

a toner containing unit containing toner;

a photoconductor on which an electrostatic latent image is formed; and a development roller that supplies the toner of the toner containing unit to the electrostatic latent image.

14. An image forming apparatus comprising:

a main body; and the cartridge of claim 1, wherein the cartridge is attached to or detached from the main body.

15. The image forming apparatus of claim 14, wherein the moving member is pivoted with respect to the pivoting shaft so as to be moved to the first and second positions, wherein the cartridge further comprises a first elastic member that applies an elastic force in a direction in which the moving member returns to the first position.

16. The image forming apparatus of claim 15, wherein the contact portion is mounted at a first end portion of the moving member, wherein when the cartridge is mounted in the main body, a second end portion of the moving member is pushed by an interference member provided in the main body so that the moving member is pivoted with respect to the pivoting shaft so as to be moved to the second position.

17. The image forming apparatus of claim 15, wherein the moving member further comprises:

a mounting portion connected to the pivoting shaft, wherein the contact portion is mounted on the mounting portion; and a lever provided at an end of the pivoting shaft to be exposed to outside of the cartridge, wherein when the cartridge is mounted in the main body, the lever is pushed by the interference member provided in the main body so that the moving member is pivoted with respect to the pivoting shaft so as to be moved to the second position.

18. The image forming apparatus of claim 15, further comprising:

a first exit through which the contact portion goes in and out;

a shutter that opens or closes the first exit; and a second elastic member that provides an elastic force to the shutter in a direction to close the first exit.

19. The image forming apparatus of claim 18, wherein the moving member includes an interference arm to push the shutter to open the first exit when the cartridge is mounted in the main body.

20. The image forming apparatus of claim 14, wherein the moving member is slid to be moved to the first and second positions.

21. The image forming apparatus of claim 20, comprising:

a rack gear formed on the moving member; and a pinion that is engaged with the rack gear and is rotated by an interference member provided in the main body when the cartridge is attached to or detached from the main body.

22. The image forming apparatus of claim 20, comprising:

a pivoting shaft including a lever that is formed at an end portion of the pivoting shaft and is exposed to outside of the cartridge such that the lever is pivoted by being pushed by an interference member provided in the main body when the cartridge is mounted in the main body;

a pinion that is rotated in connection with the pivoting shaft; and a rack gear that is formed on the moving member and is engaged with the pinion.

23. The image forming apparatus of claim 22, further comprising a first elastic member provides an elastic force so that the pinion is pivoted in a direction in which the moving member returns to the first position.

24. The image forming apparatus of claim 14, wherein the cartridge further comprises a toner containing unit containing toner.

25. The image forming apparatus of claim 14, wherein the cartridge further comprises:

a development roller; and a toner containing unit containing toner to be supplied to the development roller.

26. The image forming apparatus of claim 1, wherein the cartridge further comprises:

a toner containing unit containing toner;

a photoconductor on which an electrostatic latent image is formed; and a development roller that supplies the toner of the toner containing unit to the electrostatic latent image.

27. A image forming apparatus comprising:

a main body that allows for the insertion and removal of a cartridge;

a protrusion extending from the main body that interacts with cartridge;

a first connection portion of the main body that connects to a second connection portion of the cartridge when the cartridge is inserted in the main body;

wherein the protrusion causes the movement of the second connection portion from retracted position to a connection position or from the connection position to the retracted position.

28. The image forming apparatus of claim 27, wherein the protrusion is inserted into the cartridge to cause the movement of the second connection portion.

29. The image forming apparatus of claim 27, wherein the second connection portion is mounted on a pivotal lever that interacts with the protrusion to cause the lever to pivot.

30. The image forming apparatus of claim 27, wherein the cartridge further comprises a shutter to cover a hole that the second connection portion extends from.

31. The image forming apparatus of claim 30, wherein the movement of the second connection portion causes the shutter to move from an open to close position or from close to open position.

32. The image forming apparatus of claim 27, wherein the second connection portion is mounted on a fixture that has a lever that extends outside of the cartridge.

33. The image forming apparatus of claim 32, wherein the protrusion interacts with the lever causing the fixture to move so that the second connection portion is in either the retracted position or the connection position.

34. The image forming apparatus of claim 33, wherein the cartridge further comprises a shutter to cover a hole that the second connection portion extends from.

35. The image forming apparatus of claim 34, wherein the movement of the second connection portion causes the shutter to move from an open to close position or from close to open position.

36. The image forming apparatus of claim 27, wherein the protrusion causes the second connection portion to move in a linear fashion.

* * * * *